US008132549B2

(12) United States Patent
Dell et al.

(10) Patent No.: US 8,132,549 B2
(45) Date of Patent: Mar. 13, 2012

(54) RECIPROCATING PISTON INTERNAL COMBUSTION ENGINE AND METHOD FOR DETERMINING THE WEAR OF A TRANSMISSION ELEMENT ARRANGED BETWEEN A CRANKSHAFT AND A CAMSHAFT

(75) Inventors: Heiko Dell, Wüstenrot (DE); Jens Schafer, Herzogenaurach (DE); Thomas Pfund, Leiberstrung (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 715 days.

(21) Appl. No.: 12/063,449

(22) PCT Filed: Jul. 8, 2006

(86) PCT No.: PCT/DE2006/001183

§ 371 (c)(1),
(2), (4) Date: Jan. 29, 2009

(87) PCT Pub. No.: WO2007/016889

PCT Pub. Date: Feb. 15, 2007

(65) Prior Publication Data

US 2009/0139478 A1 Jun. 4, 2009

(30) Foreign Application Priority Data

Aug. 9, 2005 (DE) ..... 10 2005 037 517

(51) Int. Cl.
*F01L 1/34* (2006.01)

(52) U.S. Cl. ..... 123/90.15; 123/90.17; 464/160

(58) Field of Classification Search ..... 123/90.15, 123/90.17; 464/1, 2, 160
See application file for complete search history.

(56) References Cited

U.S. PATENT DOCUMENTS

| | | | | |
|---|---|---|---|---|
| 5,689,067 | A | 11/1997 | Klein et al. | |
| 5,733,214 | A | 3/1998 | Shiki et al. | |
| 7,032,552 | B2 * | 4/2006 | Schafer et al. | 123/90.17 |

FOREIGN PATENT DOCUMENTS

| | | |
|---|---|---|
| EP | 1498581 | 1/2005 |
| FR | 2850755 | 8/2004 |
| WO | 0000756 | 1/2000 |

* cited by examiner

*Primary Examiner* — Ching Chang
(74) *Attorney, Agent, or Firm* — Volpe and Koenig, P.C.

(57) ABSTRACT

A method for determining a wear value of a transmission element between a crankshaft and a camshaft of a reciprocating piston internal combustion engine, in particular a timing chain or toothed belt, is provided. The camshaft is driven by the transmission element via a drive part, for example a camshaft gearwheel. In each case, at least one measurement value for the phase position of the drive part relative to the crankshaft is determined at time intervals during which the crankshaft drives the camshaft, and the wear value is determined from the difference between the measurement values.

10 Claims, 3 Drawing Sheets

RECIPROCATING PISTON INTERNAL COMBUSTION ENGINE AND METHOD FOR DETERMINING THE WEAR OF A TRANSMISSION ELEMENT ARRANGED BETWEEN A CRANKSHAFT AND A CAMSHAFT

BACKGROUND

The invention relates to a method for determining a wear value for a transmission element, in particular, a timing chain or a toothed belt, arranged between a crankshaft and a camshaft of a reciprocating piston internal combustion engine, wherein the camshaft is driven by the transmission element via a drive part, such as, e.g., a camshaft gearwheel. In addition, the invention relates to a reciprocating piston internal combustion engine with a crankshaft, at least one camshaft, and at least one transmission element connecting these to each other, in particular, a timing chain or a toothed belt, wherein the transmission element is in driving connection with the camshaft via a drive part, such as, e.g., a camshaft gearwheel.

Such a reciprocating piston internal combustion engine with a crankshaft and two camshafts controlling intake and exhaust valves is known in practice. On the crankshaft there is a crankshaft gearwheel, which is locked in rotation with the crankshaft and which drives a timing chain. A camshaft gearwheel, which is locked in rotation with the relevant camshaft, is allocated to each camshaft and features twice the diameter of the crankshaft gearwheel. The timing chain engages with external teeth of the camshaft gearwheels and in this way transmits the rotational movement of the crankshaft to the camshafts with a rotational speed ratio of 2:1. At high rotational speeds, relatively large tensile forces occur, because the timing chain drives not only the camshaft allocated to it, but instead also the valves and valve springs activated by the camshaft. Increased running output of the internal combustion engine leads to wear, especially at the individual bearing points of the chain elements of the timing chain. Therefore, the length of the timing chain increases and the phase position of the camshaft relative to the crankshaft is changed, which has an unfavorable effect on the operating behavior of the internal combustion engine and results in an increase in fuel consumption and/or a decrease in the engine output. The state of the timing chain is therefore checked regularly, in order to replace the timing chain, if necessary, when a predetermined wear limit is reached. The checking of the timing chain, however, is relatively complicated, because parts of a control box of the reciprocating piston internal combustion engine and possibly other components, such as, e.g., an air filter, a generator, an engine cover, or the like, must be removed, in order to obtain access to the timing chain. The wear of the timing chain is determined by measuring the distance between the tensioned section and the loose section and/or by determining the position of a tensioning element of an adjustable chain tensioner when the internal combustion engine is stopped. For a precise check of the wear on the timing chain, it is even necessary to disassemble the timing chain. It is also disadvantageous that the intervals, within which the timing chain must be checked, must be designed for the most unfavorable operating conditions of the internal combustion engine, so that even under the most unfavorable operating conditions, the reaching of the wear limit of the timing chain can be recognized in due time and the timing chain can be replaced.

SUMMARY

Therefore, there is the objective of creating a method and a reciprocating piston internal combustion engine of the type noted above, which allows a simple way to determine a wear value for the transmission element.

This objective is met with respect to the method of the type noted above in that, at spaced apart time points, at which the crankshaft drives the camshaft, at least one measurement value for the phase position of the drive part relative to the crankshaft is detected and that the wear value is determined from the difference between these measurement values.

Advantageously, it is therefore possible to check the wear of the transmission element during the operation of the reciprocating piston internal combustion engine, so that a time-intensive and expensive disassembly of a control box and/or other components of the internal combustion engine can be eliminated. Thus, the transmission element needs to be maintained only when the wear limit is actually reached. Thus, the maintenance costs decrease and the availability of the internal combustion engine increases.

In an advantageous embodiment of the invention, the camshaft is connected via an adjustment device so that it can rotate with the drive part, wherein the adjustment device is adjusted so that it is arranged in a predetermined adjustment position when detecting the measurement values for the phase position, wherein, for the rotational position of the crankshaft, a crankshaft sensor signal is detected, wherein the camshaft is driven via the transmission element by the crankshaft and rotated relative to the drive part, such that the camshaft runs through a camshaft reference position at two or more spaced apart time points, wherein the passage of the camshaft reference position is detected, in order to allocate a camshaft angle value to the camshaft reference position with reference to the crankshaft sensor signal, and wherein, with these crankshaft angle values as measurement values for the phase position, the wear value is determined. With the help of the adjustment device, the opening and closing times of the valves can be adapted in a known way to the relevant operating state of the internal combustion engine, for example, to the crankshaft rotational speed and/or the operating temperature. The crankshaft sensor signal needed for controlling the adjustment device and a measurement signal for the camshaft reference position can be used both for regulating the phase position to a desired value and also for determining the wear value of the transmission element.

In another advantageous construction of the invention, the camshaft is connected to the drive part so that it can rotate by the adjustment device, wherein the adjustment device is adjusted such that it is arranged in a predetermined adjustment position when the measurement values for the phase position are detected in a predetermined adjustment position, wherein, for the rotational position of the camshaft, a camshaft sensor signal is detected, wherein the camshaft is driven by the crankshaft via the transmission element, such that this runs through a crankshaft reference position at two or more spaced apart time points, wherein the passage of the crankshaft reference position is detected, in order to allocate a camshaft angle value to the crankshaft reference position with reference to the camshaft sensor signal, and wherein, with these camshaft angle values as measurement values for the phase position, the wear value is determined. With this construction of the invention, the wear value can also be determined in a simple way.

It is advantageous when the wear value is compared with a limit value and when an error state is detected when the limit value is exceeded. Reaching the limit value can then be reported to the user of the internal combustion engine, for example, by a corresponding display.

In a preferred embodiment of the invention, the rotational angle position of the camshaft is adjusted as a function of the wear value relative to the transmission element, such that the influence of the wear of the transmission element is at least partially compensated to the phase angle between the camshaft and the crankshaft. Therefore, low wear of the transmission element can be compensated, so that the valve timing practically does not change due to the wear and the internal combustion engine maintains its full power capacity over its entire service life.

It is advantageous when several wear values are determined and buffered for different operating states of the reciprocating piston internal combustion engine, especially for different operating temperatures and/or crankshaft rotational speeds, and when the rotational angle position of the camshaft is adjusted relative to the transmission element preferably as a function of the wear value allocated to each operating state of the reciprocating piston internal combustion engine. Therefore, the wear of the transmission element can be compensated even more precisely.

In a preferred construction of the invention, the adjustment device features an adjustment gear mechanism, which is constructed as a triple-shaft gear mechanism with a transmission element-fixed drive shaft, a camshaft-fixed driven shaft, and an adjustment shaft driven by an electric motor, a) wherein a first crankshaft rotational angle measurement signal is set to a rotational angle measurement signal start value,
b) wherein the crankshaft rotates and for an appearance of a state change of the first crankshaft sensor signal, the rotational angle measurement signal is tracked,
c) wherein, when reaching the crankshaft reference position, a reference mark is generated in the crankshaft sensor signal,
d) wherein, when the reference mark appears, a second rotational angle measurement signal is set to a value allocated to the crankshaft reference position,
e) wherein the second rotational angle measurement signal is tracked when a state change of the crankshaft sensor signal appears,
f) wherein a position measurement signal is set to a position measurement signal start value,
g) wherein the adjustment shaft rotates and an adjustment shaft sensor signal is detected, which changes its state for a change in the rotational position of the adjustment shaft,
h) wherein, the position measurement signal is tracked when a state change of the adjustment shaft sensor signal appears,
i) wherein, when reaching the camshaft reference position, a camshaft reference signal is generated, and
k) wherein, the measurement values of the second rotational angle measurement signal present when the camshaft reference signal appears and the position measurement signal are determined and with these measurement values and a gear parameter of the triple-shaft gear mechanism, the measurement values for the phase position are determined.

The measurement values for the phase position are thus determined indirectly from the measurement values of the second rotational angle measurement signal, the positional measurement signal, and a gear parameter, such as, e.g., the stationary gear transmission ratio of the triple-shaft gear mechanism. Therefore, the phase position and thus the wear value can be easily determined with great precision.

With respect to the reciprocating piston internal combustion engine, the previously mentioned objective is met in that the reciprocating piston internal combustion engine has a measurement device for the phase position of the drive part relative to the crankshaft, that the measurement device is connected to a data memory featuring at least one memory location, in which a measurement value for the phase position is stored, and that the measurement device is connected to an evaluation device, which is constructed for determining a wear value for the transmission element made from at least two phase position measurement values detected at different time points.

It is advantageous when the drive part is rotated by an adjustment device for changing the phase position of the camshaft relative to the crankshaft and can be locked in rotation with the camshaft in different rotational positions. In this way, the opening and/or closing times of the valves can be adapted to the corresponding operating state of the internal combustion engine. A crankshaft sensor needed for controlling the adjustment device and a sensor for detecting the camshaft reference position can be used both for regulating the phase position to a desired value and also for determining the wear value of the transmission element.

For a preferred construction of the invention, the adjustment device is constructed as a triple-shaft gear mechanism with a transmission element-fixed drive shaft, a camshaft-fixed driven shaft, and an adjustment shaft driven by an electric motor. The phase position between the camshaft and crankshaft can then be set electrically with great precision.

It is advantageous when the adjustment device has limit stops for limiting the adjustment angle between the drive shaft and the driven shaft. For measuring the phase position of the drive part relative to the crankshaft, the adjustment device can then be positioned against the limit stops, in order to tension the drive part in a defined rotational angle position with the camshaft.

BRIEF DESCRIPTION OF THE DRAWINGS

Below, an embodiment of the invention is explained in more detail with reference to the drawing. Shown are.

DETAILED DESCRIPTION OF THE PREFERRED EMBODIMENTS

Figure 1:
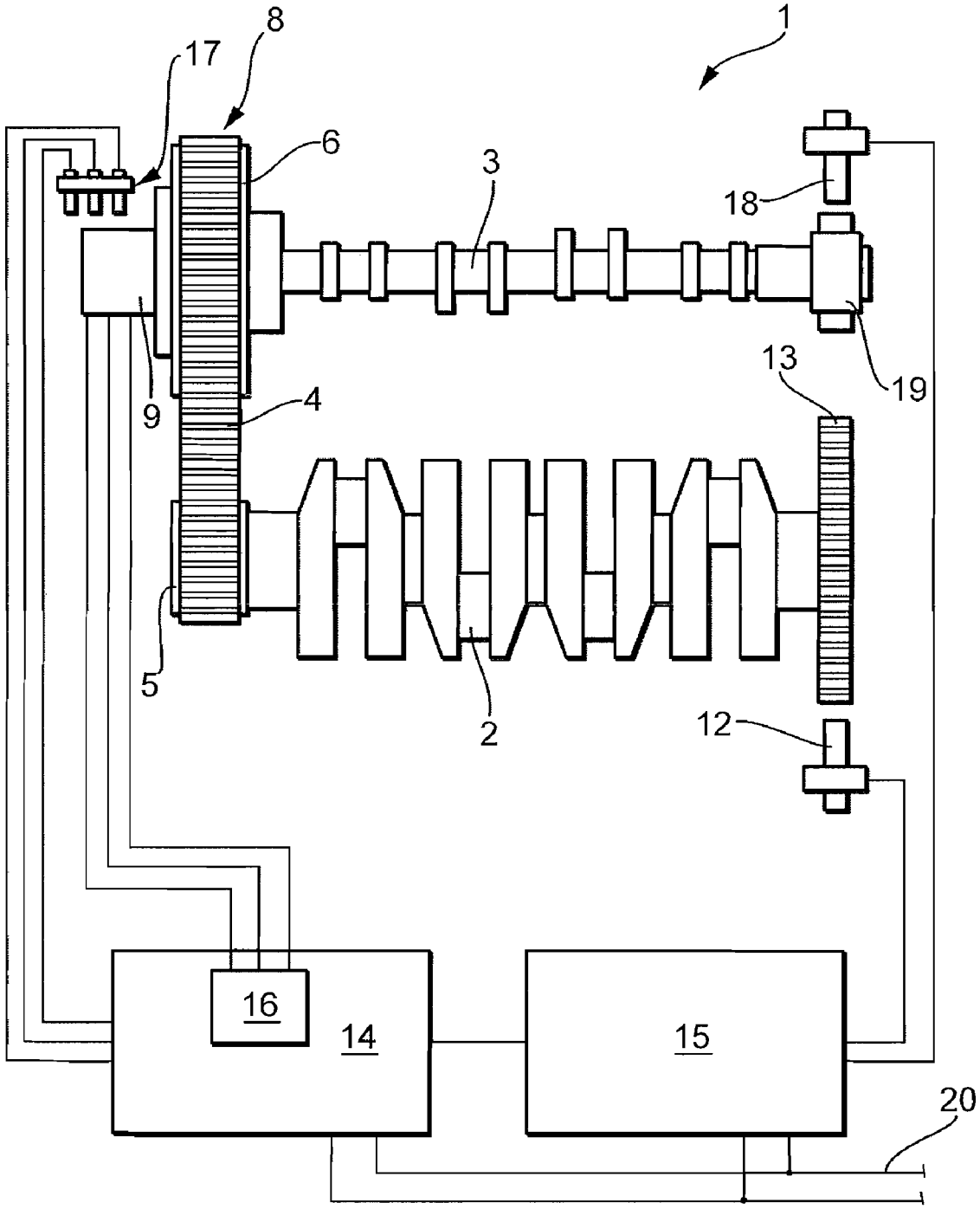
FIG. 1 is a schematic view of an internal combustion engine, which has an adjustment device for adjusting the rotational angle position of the camshaft relative to the crankshaft.

A reciprocating piston internal combustion engine 1 shown schematically in FIG. 1 has a crankshaft 2, a camshaft 3, and a transmission element 4, which can be a timing chain or a toothed belt. A crankshaft gearwheel 5, which is locked in rotation with the crankshaft 2 and which engages with the transmission element 4, is arranged on the crankshaft 2. As the drive part 6, a camshaft gearwheel, which is in driving connection with the camshaft 3, is provided on the camshaft 3. The transmission element 4 is guided by the crankshaft gearwheel 5 and the drive part 6 and engages with these parts. For tensioning the transmission element 4 there is a tensioning device 7, which has a contact-pressure element, such as, e.g., a roll or a sliding rail, which engages the outer peripheral side of the transmission element 4 against the restoring force of a spring.

Figure 2:
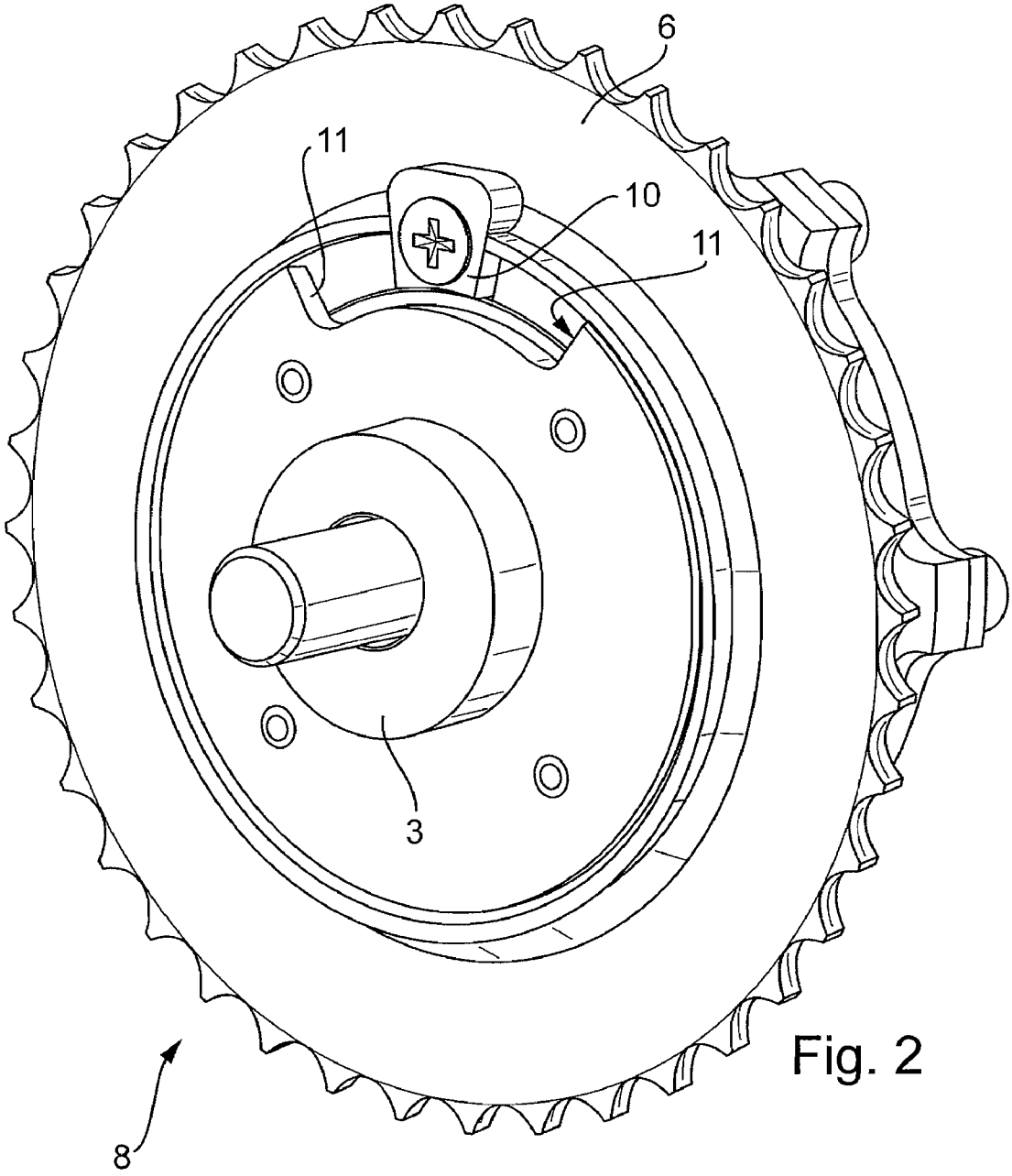
FIG. 2 is a view of an adjustment device.

Between the drive part 6 and the camshaft 3 there is an adjustment device 8, which is shown in more detail in FIG. 2 and with which the rotational angle position of the camshaft 3 relative to the crankshaft 2 can be adjusted. The adjustment device 8 is constructed as a triple-shaft gear mechanism with a drive shaft locked in rotation with the drive part 6, a camshaft-fixed driven shaft, and an adjustment shaft. The adjustment gear mechanism can be a rotating gear, preferably a planetary gear. The adjustment shaft is locked in rotation with the rotor of an electric motor 9.

The adjustment gear mechanism is integrated in a hub of the drive part 6. For limiting the rotational angle between the camshaft 3 and the crankshaft 2, the adjustment device 8 has a stop element 10 connected rigidly to the drive shaft and a counter stop element 11, which is locked in rotation with the camshaft 3 and contacts the stop element 10 in the position of use in a stop position.

In FIG. 1, it can be seen that for measuring the crankshaft rotational angle there is a magnetic detector 12, which detects the tooth flanks of a toothed collar 13 arranged on the crankshaft 2 and made from a magnetically conductive material. One of the tooth gaps or teeth of the toothed collar 13 has a greater width than the other tooth gaps or teeth and marks a crankshaft reference position. When the crankshaft reference position is reached, a reference mark is generated in the sensor signal of the magnetic detector 12, which is also designated below as the crankshaft sensor signal. In this way it is achieved that the crankshaft-toothed collar 13 at the crankshaft reference position has a greater gap than between its other teeth. As soon as the reference mark is detected in the crankshaft sensor signal, a rotational angle measurement signal is set to a value allocated to the reference rotational angle position. In this way, the rotational angle measurement signal is tracked for each change in the state of the crankshaft sensor signal, in that, in an operating program of an adjustment angle control device 14, an interrupt is triggered, in which the rotational angle measurement signal is incremented.

As the electric motor 9, an EC motor is provided, which has a rotor, on whose periphery there is a series of magnetic segments, which are magnetized alternately in opposite directions and which interact magnetically via an air gap with teeth of a stator. The teeth are wound with a winding that is energized by a control device 16 integrated in a motor controller 15.

The position of the magnetic segments relative to the stator and thus the adjustment shaft rotational angle is detected with the help of a measurement device, which has, on the stator, several magnetic field sensors 17 that are offset to each other in the peripheral direction of the stator, such that for each rotation of the rotor, a number of magnetic segment-sensor combinations are run through. The magnetic field sensors 17 generate a digital sensor signal, which runs through a series of sensor signal states, which repeat as often as the measurement device has magnetic field sensors 17 for a mechanical full rotation of the rotor. This sensor signal is designated below also as an adjustment shaft sensor signal.

When the internal combustion engine is started—independent of the position, in which the rotor or the adjustment shaft is currently located—a positional measurement signal is set to a positional measurement signal starting value. Then the adjustment shaft is rotated, wherein for each state change of the adjustment shaft sensor signal in the operating program of the adjustment angle control device 14, an interrupt is triggered, in which the positional measurement signal is tracked.

As a reference signal generator for the camshaft rotational angle, a Hall sensor 18 is provided, which interacts with a trigger wheel 19 arranged on the camshaft 3. When a predetermined rotational angle position of the camshaft 3 is reached, a flank is generated in a camshaft reference signal. When the Hall sensor 18 detects the flank, in the operating program of the adjustment angle control device 14 an interrupt is triggered, in which the crankshaft rotational angle and the adjustment shaft rotational angle are buffered for regulating the phase angle for further processing. This interrupt is also designated below as a camshaft interrupt. Finally, in the operating program of the adjustment angle control device 14, a time slice-controlled interrupt is also triggered, which is designated below as a cyclical interrupt.

With the help of the crankshaft rotational angle measurement signal, the positional measurement signal, and a gear parameter, namely the transmission ratio, which the adjustment gear mechanism exhibits for a stationary drive shaft between the adjustment shaft and the camshaft 3, the current phase angle is calculated:

$$\varepsilon_{Acti}(t) = \varepsilon_{Abs} + \frac{1}{-i_g} \cdot \begin{pmatrix} 2 \cdot [\varphi_{Em,ICyc} - \varphi_{Em,ICam}] - \\ [\varphi_{Cnk,ICyc} - \varphi_{Cnk,Icam}] \end{pmatrix}$$

Here, $\phi_{Em,ICyc}=\phi_{Em}(t_{ICyc})$ is the rotational angle of the rotor of the electric motor 9 from the last detected crankshaft reference mark up to the current cyclical interrupt, $\phi_{Cnk,ICyc}=\phi_{Cnk}(t_{ICyc})$ is the rotational angle of the crankshaft 3 from the last recognized crankshaft reference mark up to the current cyclical interrupt, $\phi_{Em,ICam}$ is the rotational angle of the electric motor 9 from the last recognized crankshaft reference mark up to the last camshaft interrupt, $\phi_{Cnk,ICam}$ is the rotational angle of the crankshaft 3 from the last recognized crankshaft reference mark up to the last camshaft interrupt, $\epsilon_{Abs}$ is the absolute phase angle, which is determined through measurement for each camshaft interrupt and which is equal to the crankshaft rotational angle $\phi_{Cnk,ICyc}$ at this time point.

The phase angle signal is thus tracked, starting from a reference rotational angle value, for a state change of the crankshaft sensor signal and/or the adjustment shaft sensor signal. The phase angle signal determined in this way is regulated to a desired phase angle signal, which is prepared by the motor controller 15.

For determining a wear value, which represents a measure for the elongation of the transmission element 4 caused by wear during the operation of the internal combustion engine 1, while the crankshaft 2 drives the camshaft 3 via the transmission element 4, initially for different operating states of the internal combustion engine, such as, e.g., different crankshaft rotational speeds and/or different operating temperatures, a first measurement value is detected for the phase position of the drive part 6 relative to the crankshaft 2. For this purpose, initially the drive part 6 is brought into a predetermined adjustment position relative to the camshaft 3, for example, in the already mentioned stop position or an emergency running position, which is controlled with the help of the electric motor 9. When this adjustment position is reached, which can be checked, for example, for the stop position by detecting a change of the phase speed and/or current consumption of the electric motor 9, each time—as described above—the absolute phase angle between the camshaft 3 and the crankshaft 2 is measured. The measurement values for the phase angle can be determined, for example, on an engine test bed. These values are stored in a non-volatile data memory.

During the measurement of the phase angle, the crankshaft rotational speed is held essentially constant, in order to avoid sensor drift, as can occur, for example, for rotational speed ramps. In addition, as much as possible the torque of the crankshaft 2 is not changed during the measurement value detection, so that no phase shifts occur in the change between a push and a pull phase. Noise caused by oscillations of the control drive in the phase angle measurement signal can be removed by filtering the measurement signal.

At a later time point, at which the operating state of the internal combustion engine 1 corresponds approximately to the operating state at the time point of the measurement of a first phase position measurement value stored in the data memory, at least one second measurement value for the phase position is determined in a corresponding way. Then, in the adjustment angle control device 14, the difference from the first measurement value stored in the data memory and the second measurement value is formed, in order to determine the wear value for the transmission element 4.

The wear value is then compared with a limit value or a permitted range. If the wear value exceeds the limit value or lies outside of the permitted range, an error state is detected and a corresponding error message is entered into the data memory. If necessary, the error state can be displayed with the help of a display device, for example, on the dashboard of a motor vehicle.

Figure 3:
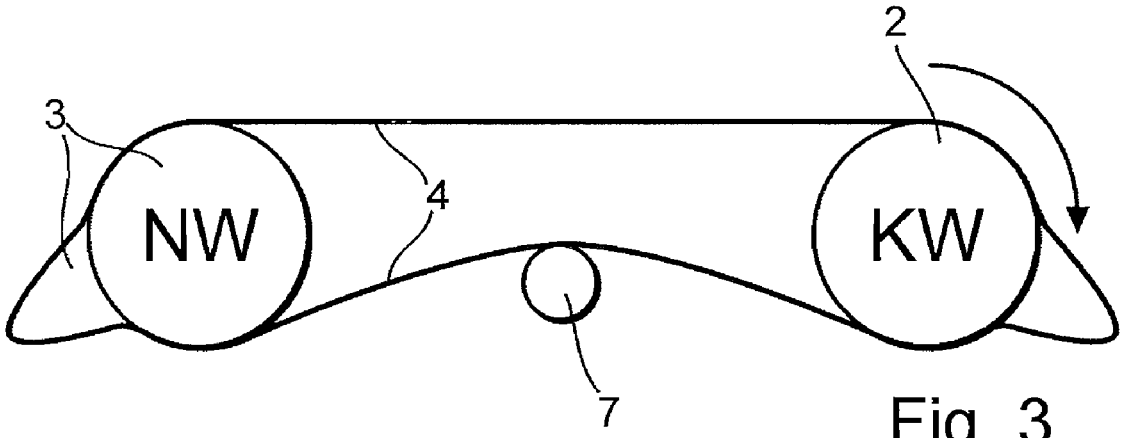
FIG. 3 is a top view of a crankshaft and a camshaft gearwheel, which are connected to each other via a timing chain, wherein the timing chain is new.
Figure 4:
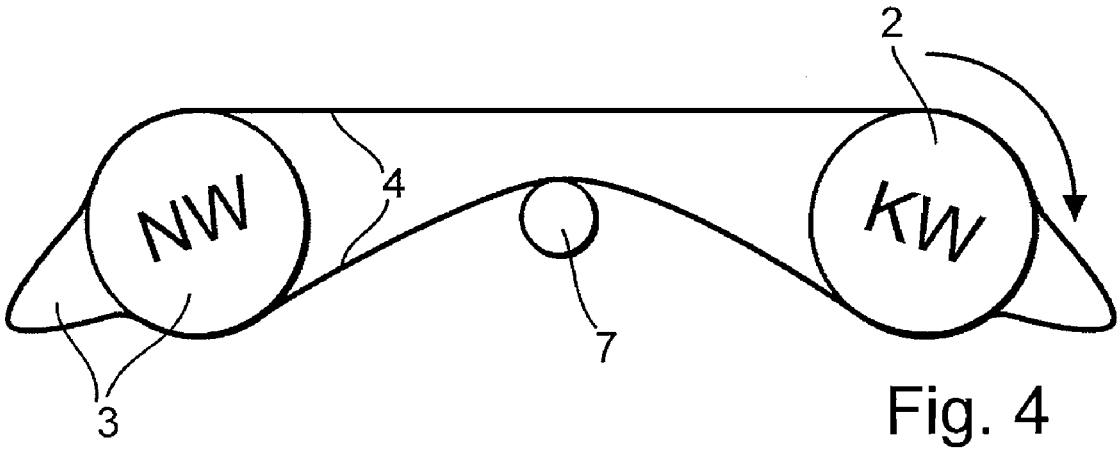
FIG. 4 is a view similar to FIG. 3, wherein the timing chain is longer than in FIG. 3 due to wear.

In FIGS. 3 and 4 it can be seen that for an increase in length of the transmission element, the phase angle between the camshaft 3 and the crankshaft 2 would actually be adjusted. In order to prevent this, the rotational angle position of the camshaft 3 is changed within the adjustment range of the adjustment device 8 through corresponding positioning of the electric motor 9 as a function of the wear value relative to the transmission element 4, such that the influence of the wear of the transmission element 4 to the phase angle between the camshaft 3 and crankshaft 2 is compensated.

$$\epsilon(t)=\phi_{Cnk}(t)-2\cdot\phi_{Cam}(t)-\Delta\phi_{Langung}$$

Here, $\epsilon$(t) denotes the absolute phase angle, t denotes the considered time point, $\phi_{Cnk}$(t) denotes the current crankshaft rotational angle at time t, $\phi_{Cam}$(t) denotes the current camshaft rotational angle at time t, and $\Delta\phi_{Langung}$ denotes the measured elongation of the transmission element.

It should also be mentioned that for a repeated or constant measurement of the wear value, even a failure of the tensioning device could be determined, when a jump-like change of the wear value, which starts above a certain value, is detected. Here, it is even possible to realize an emergency running strategy, for which the selected phase angle is set and held. The failure of the tensioning device can be further transmitted from the adjustment angle control device 14 to the motor controller 15, for example, by means of a CAN-BUS 20.

LIST OF REFERENCE SYMBOLS

1 Reciprocating piston internal combustion engine
2 Crankshaft
3 Camshaft
4 Transmission element
5 Crankshaft gearwheel
6 Drive part
7 Tensioning device
8 Adjustment device
9 Electric motor
10 Stop element
11 Counter stop element
12 Magnetic detector
13 Toothed collar
14 Adjustment angle control device
15 Engine controller
16 Trigger device
17 Magnetic-field sensor
18 Hall sensor
19 Trigger wheel
20 CAN-BUS

The invention claimed is:

1. A method for determining a wear value for a transmission element arranged between a crankshaft and a camshaft of a reciprocating piston internal combustion engine, comprising: driving the camshaft by the transmission element via a drive part, detecting at least one measurement value for a phase position of the drive part relative to the crankshaft at spaced apart time points, during which the crankshaft drives the camshaft, determining a wear value from a difference between the measurement values, and adjusting a rotational angle between the camshaft and the crankshaft based on the wear value via an adjustment device connected to the drive part.

2. The method according to claim 1, further comprising the camshaft being connected to the drive part so that the drive part can rotate via the adjustment device such that the adjustment device is arranged in a predetermined adjustment position when the measurement values for the phase position are detected, detecting a crankshaft sensor signal for a rotational position of the crankshaft, the camshaft being driven by the crankshaft by the transmission element and rotated relative to the drive part, such that the camshaft runs through a camshaft reference position at two or more spaced apart time points, detecting a passage of the camshaft reference position in order to allocate a crankshaft angular value to the camshaft reference position with reference to the crankshaft sensor signal, and determining the wear value with the crankshaft angle values as the measurement values for the phase position.

3. The method according to claim 2, wherein the adjustment device has an adjustment gear mechanism, which is constructed as a triple-shaft gear mechanism with a transmission element-fixed drive shaft, a camshaft-fixed driven shaft, and an adjustment shaft driven by an electric motor, the method further comprising: a) setting a first crankshaft rotational angle measurement signal to a rotational angle measurement signal starting value, b) rotating the crankshaft and the rotational angle measurement signal is tracked when a state change of the first crankshaft sensor signal occurs, c) generating a reference mark in the crankshaft sensor signal when the crankshaft reference position is reached, d) setting a second rotational angle measurement signal to a value allocated to the crankshaft reference position when the reference mark appears, e) tracking the second rotational angle measurement signal when a state change of the crankshaft sensor signal occurs, f) setting a positional measurement signal to a position measurement signal starting value, g) rotating the adjustment shaft and detecting an adjustment shaft sensor signal which changes state for a change in the rotational position of the adjustment shaft, h) tracking the positional measurement signal for an appearance of a state change of the adjustment shaft sensor signal, i) generating a camshaft reference signal when the camshaft reference position is reached, and k) determining the current measurement values of the second rotational angle measurement signal and the positional measurement signal when the camshaft reference signal appears, and with the measurement values and a gear parameter of the triple-shaft gear mechanism, determining the measurement values for the phase position.

4. The method according to claim 1, further comprising the camshaft being connected to the drive part so that the camshaft can rotate via the adjustment device such that the adjustment device is arranged in a predetermined adjustment position when the measurement values for the phase position are detected, detecting a camshaft sensor signal for the rotational position of the camshaft, the camshaft being driven by the crankshaft via the transmission element, such that the crankshaft runs through a crankshaft reference position at two or more spaced apart time points, detecting the passage of the crankshaft reference position in order to allocate a camshaft angle value to the crankshaft reference position with reference to the camshaft sensor signal, and determining the wear value with the camshaft angle values as the measurement values for the phase position.

5. The method according to claim 1, wherein the wear value is compared with a limit value and that, when the limit value is exceeded, an error state is detected.

6. The method according to claim 1, wherein a rotational angle position of the camshaft is adjusted as a function of the wear value relative to the transmission element, such that an influence of the wear of the transmission element on the phase angle between the camshaft and crankshaft is at least partially compensated.

7. The method according to claim 1, wherein several wear values are determined and buffered for different operating states of the reciprocating internal combustion engine and a rotational angle position of the camshaft relative to the transmission element is adjusted as a function of the wear value allocated to the corresponding operating state of the reciprocating piston internal combustion engine.

8. A reciprocating piston internal combustion engine comprising a crankshaft, at least one camshaft, and at least one transmission element connecting the shafts to each other, wherein the transmission element is in driving connection with the camshaft via a drive part, a measurement device for determining a phase position of the drive part relative to the crankshaft the measurement device is connected to a data memory, which has at least one memory location, in which a measurement value is stored, and the measurement device is connected to an evaluation device, which is constructed for determining a wear value for the transmission element from phase position measurement values detected at two or more different time points, wherein the drive part is rotated via an adjustment device for changing a phase position of the camshaft relative to the crankshaft and can be locked in rotation with the camshaft in different rotational positions.

9. The reciprocating piston internal combustion engine according to claim 8, wherein the adjustment device is constructed as a triple-shaft gear mechanism with a transmission element-fixed drive shaft, a camshaft-fixed driven shaft, and an adjustment shaft driven by an electric motor.

10. The reciprocating piston internal combustion engine according to claim 9, wherein the adjustment device has limit stops for limiting an adjustment angle between the drive shaft and the driven shaft.

* * * * *